United States Patent [19]

Langer et al.

[11] Patent Number: 5,073,307

[45] Date of Patent: Dec. 17, 1991

[54] MEMBRANE CARBURETOR FOR AN INTERNAL COMBUSTION ENGINE OF A HANDHELD PORTABLE TOOL

[75] Inventors: Michael Langer, Fellbach; Joachim Schommers, Allmersbach i.T., both of Fed. Rep. of Germany

[73] Assignee: Andreas Stihl, Waiblingen, Fed. Rep. of Germany

[21] Appl. No.: 475,274

[22] Filed: Feb. 5, 1990

[30] Foreign Application Priority Data

Feb. 3, 1989 [DE] Fed. Rep. of Germany ..... 3903192

[51] Int. Cl.[5] ..... F02M 17/04

[52] U.S. Cl. ..... 261/35; 261/DIG. 68

[58] Field of Search ..... 261/DIG. 68, 35

[56] References Cited

U.S. PATENT DOCUMENTS

| | | | |
|---|---|---|---|
| 2,214,964 | 9/1940 | Leibing | 261/DIG. 19 |
| 2,680,605 | 6/1954 | Bracke | 261/DIG. 19 |
| 3,001,774 | 9/1961 | Sarto | 261/DIG. 67 |
| 3,174,732 | 3/1965 | Brown | 261/DIG. 68 |
| 3,236,505 | 2/1966 | Phillips | 261/DIG. 68 |
| 3,281,128 | 10/1966 | Phillips | 261/34.2 |
| 3,368,326 | 2/1968 | Hervert | 261/DIG. 67 |
| 3,852,391 | 12/1974 | Hisatomi et al. | 261/DIG. 19 |
| 4,323,522 | 4/1982 | Rasmussen | 261/DIG. 67 |

*Primary Examiner*—Tim Miles

*Attorney, Agent, or Firm*—Walter Ottesen

[57] ABSTRACT

The invention relates to a membrane carburetor having an air filter connected upstream of the intake channel. The combustion air passes through the air filter and into the intake channel of the carburetor and coacts with the fuel drawn into the intake channel to form a fuel/air-mixture which enters the combustion chamber of the engine communicating with the intake channel. The compensation chamber of the carburetor is connected exclusively to the clean-air side of the air filter in order to avoid an overenrichment of the mixture when the filter material of the air filter becomes contaminated. The membrane carburetor can be used on two-stroke engines for portable handheld tools such as motor chain saws, cutoff machines, brushcutters or the like.

7 Claims, 3 Drawing Sheets

MEMBRANE CARBURETOR FOR AN INTERNAL COMBUSTION ENGINE OF A HANDHELD PORTABLE TOOL

FIELD OF THE INVENTION

The invention relates to a membrane carburetor for an internal combustion engine such as a two-stroke engine of a portable handheld tool such as a motor chain saw, cutoff machine, brushcutter or the like.

BACKGROUND OF THE INVENTION

Membrane carburetors and are known per se and they include a control membrane defining a partition wall between a fuel-filled fuel chamber and a compensating chamber. The compensating chamber is, as a rule, vented to the atmosphere. The combustion air flows in through the intake channel into the combustion chamber of the engine and generates an underpressure in the intake channel. This underpressure causes the fuel to enter the intake channel from the fuel chamber. The fuel passed into the intake channel leads to an underpressure in the fuel chamber whereby the control membrane is moved and a control valve is opened by means of which fuel is resupplied to the fuel chamber.

The combustion air drawn in by suction is drawn through an air filter for cleaning and the material of this filter becomes contaminated with increasing operational use whereby an underpressure builds up at the clean-air side of the air filter and this underpressure continuously increases with increasing contamination. The combustion air flowing through the air filter and via the intake channel into the combustion chamber therefore decreases in quantity and the underpressure in the intake channel increases thereby causing the fuel-/air-mixture to become richer. A richer fuel/air-mixture leads to an incomplete combustion and thereby to a reduced quality of the exhaust gas with increased fuel consumption.

SUMMARY OF THE INVENTION

It is an object of the invention to provide a membrane carburetor wherein the level of contamination of the air filter is considered with the formation of the fuel/air-mixture.

The membrane carburetor of the invention is for an internal combustion engine such as a two-stroke engine of a portable handheld tool such as a motor chain saw, cutoff machine, brushcutter or the like. The membrane carburetor includes: a housing having an interior space and defining an intake channel communicating with the engine through which a stream of air is drawn by suction when the engine is operating; an air filter mounted upstream of the intake channel for filtering and passing the stream of air into the channel; the air filter having a clean-air side downstream of the filter; a movable control membrane having two sides and mounted in the interior space of the carburetor housing so as to define a fuel chamber on one side of the membrane from which fuel is drawn into the intake chamber to form a fuel/air-mixture with the intake air and a closed compensation chamber on the other side of the membrane; and, connecting channel means for connecting the compensation chamber to the stream of air at a location downstream of the clean-air side of the air filter.

According to a feature of the invention, the underpressure which develops at the clean-air side of the air filter with increasing contamination of the filter material effects a compensation on the control membrane of the membrane carburetor. The increased underpressure self-adjusts in the intake channel and no longer leads to an increased entry of fuel; rather, the fuel supplied is reduced in correspondence to the reduced quantity of through-flowing combustion air. This leads to the condition that the quality of the fuel/air-mixture remains substantially the same even for a filter material which becomes increasingly clogged. The exhaust gas quality therefore continues to substantially correspond to the adjusted variables.

In a preferred embodiment of the invention, the ratio of the membrane surface to the channel cross section is less than 50 to 1 and is preferably less than 25 to 1. Excellent results are obtained with a ratio of 10 to 1.

In a further embodiment of the invention, an intermediate wall is provided in the compensation chamber and has an opening which is preferably centrally located. The ratio of the membrane surface to the cross section of the opening is adjusted to be less than 200 to 1 with the opening cross section having a minimum area of approximately 3 $mm^2$.

In an advantageous embodiment of the invention, the connecting channel is configured as a insert channel to provide a connection with the housing of the air filter.

It is important to note that the connection of the compensation chamber with the clean-air side of the air filter of the same membrane carburetor can be obtained also with other air filters without changing its adjustment even though such other filters can, for example, provide a lower air throughput. With a lower air throughput, the underpressure which builds up on the clean-air side has a compensating effect on the control membrane so that an optimal composition of the fuel-/air-mixture is obtained independently of the type of air filter.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
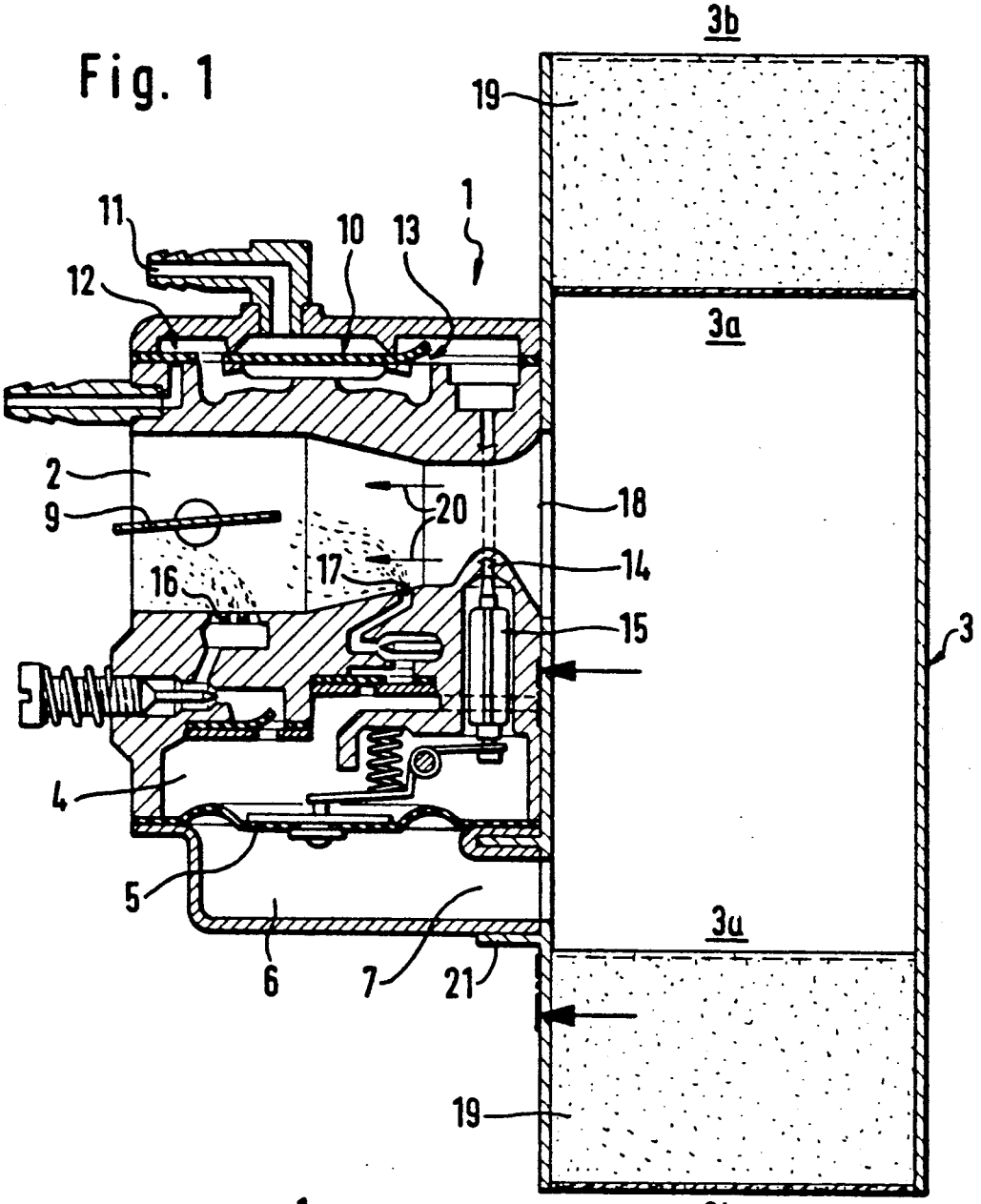
FIG. 1 is a section view taken through a membrane carburetor with the air filter mounted thereon.

The membrane carburetor 1 shown in FIG. 1 includes an intake channel 2 having a throttle flap 9 mounted therein. The membrane carburetor 1 has a membrane fuel pump 10 integrated into its housing. The pump chamber of the pump 10 is charged with the pressure of a two-stroke engine which is present in the crankcase thereof via a connecting channel 11. The carburetor 1 is mounted on the engine (not shown). The fuel pump 10 draws fuel from a fuel tank (not shown) via a check valve 12 and pumps the same via a second check valve 13 into the fuel chamber 4 in the housing of the membrane carburetor 1. The inlet channel 14 in the fuel chamber 4 is controlled by a control valve 15 which, in turn, is controlled by a control membrane 5 delimiting the fuel chamber 4.

The fuel from the fuel chamber 4 reaches the intake channel 2 via valve systems having adjustable throttles and respective inlet openings 16 and 17.

An air filter 3 is arranged at the input 18 of the intake channel 2. The filter 3 is configured as a toroidal filter in the illustrated embodiment. The filter material 19 arranged in the housing of the air filter 3 separates the clean-air side 3*a* from the contaminated side 3*b*.

For a running two-stroke engine, the combustion air 20 flows from the clean-air side 3*a* of the filter 3 through the throttle flap 9 to the combustion chamber of the engine. Because of the configuration of the intake channel 2, fuel is drawn in by suction via inlet openings 16 and 17 whereby an ignitable fuel/air-mixture enters the combustion chamber. An underpressure develops in the fuel chamber 4 because of the fuel entering into the intake channel. The underpressure causes the control membrane 5 to move into the fuel chamber 4 and opens the control valve 15 via an angle lever acting at the center of the control membrane 5 so that fuel can be resupplied to compensate for the underpressure in the fuel chamber 4.

A compensation chamber 6 is provided at the side of the control membrane 5 facing away from the fuel chamber 4. The compensation chamber 6 is closed with respect to the atmosphere and, according to the invention, is connected to the clean-air side 3*a* of the air filter 3. In this way, the condition is achieved that with an increased level of contamination of the filter material 19, the underpressure which builds up at the clean-air side 3*a* becomes effective in the compensation chamber 6 whereby a flow of fuel from the inlet openings 16 and 17 which is too great is prevented. This type of compensation assures that the fuel/air-mixture supplied to the combustion chamber is not over-enriched with an increasing degree of contamination of the filter material 19.

In a preferred embodiment of the invention, the channel cross section of the connecting channel 7 is selected so that the ratio of the membrane surface of the control membrane 5 to the channel cross section of the connecting channel 7 is less than 50:1. In this context, a minimal channel cross section of approximately 25 $mm^2$ is advantageous.

Figure 2:
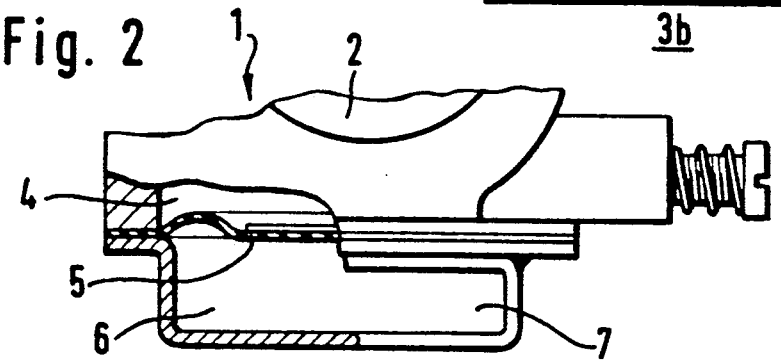
FIG. 2 is a broken-out portion, partially in section, of the carburetor of FIG. 1 and shows the compensation chamber and connecting channel with the air filter removed.

A channel configuration which is advantageous for specific components is shown in FIG. 2. The connecting channel 7 is preferably rectangular and corresponds approximately to the diameter of the compensation chamber 6 which is configured so as to be circular. In a preferred embodiment, the height of the connecting channel 7 is approximately the same as the height of the compensating chamber 6.

It is advantageous to provide the connecting channel 7 as an insert channel for communicating with the clean-air side 3*a*of the air filter housing. For this purpose, a sleeve-like connecting piece 21 on the air filter housing can be advantageous into which the free end of the connecting channel 7 is inserted so as to be approximately airtight.

An excellent compensating effect is obtained if the ratio of the membrane surface to the channel cross section is less than 25:1 and preferably less than 10:1.

Figure 3:
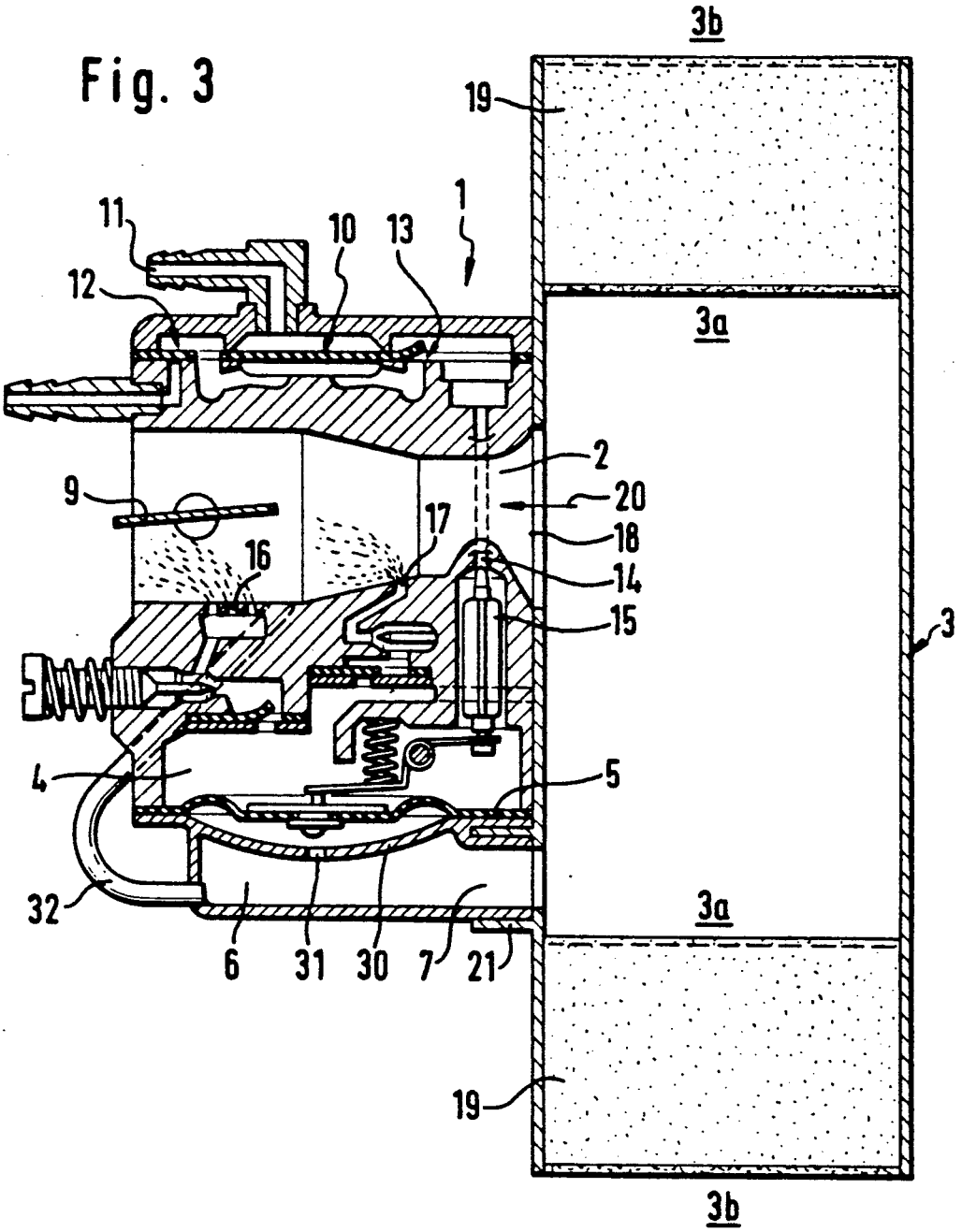
FIG. 3 is a side elevation view, in section, of the carburetor of FIG. 1 showing an intermediate wall arranged in the compensating chamber and a venting channel.

The embodiment of FIG. 3 corresponds essentially to that shown in FIG. 1 and therefore the same parts are provided with the same reference numeral. However, an intermediate wall 30 is arranged in the compensation chamber 6. In the embodiment shown, the intermediate wall 30 has an opening 31 which is centrally disposed. The opening 31 can have any desired form; however, this opening is preferably circular. With an embodiment of this kind, it has been shown that an excellent compensation effect is obtained when the ratio of the membrane surface to the cross-sectional area of the opening 31 is less than 200:1 and is preferably less than 65:1. The cross section of the opening 31 should have a minimal area of approximately 3 $mm^2$. Excellent compensating performance was obtained with a minimal area of preferably 12 $mm^2$.

In another advantageous embodiment of the invention shown in FIG. 3, the compensation chamber 6 is connected with an underpressure section in the intake channel 2 via a venting channel 32. In this way, fuel which has deposited in the compensation chamber 6 is always drawn into the intake channel 2 via suction as may be required so that the compensation chamber does not become filled with fuel and the compensation provided remains functional.

The venting channel advantageously opens into the intake channel 2 ahead of the throttle flap 9 when viewed in the direction of flow of the air drawn in by suction.

Figure 4:
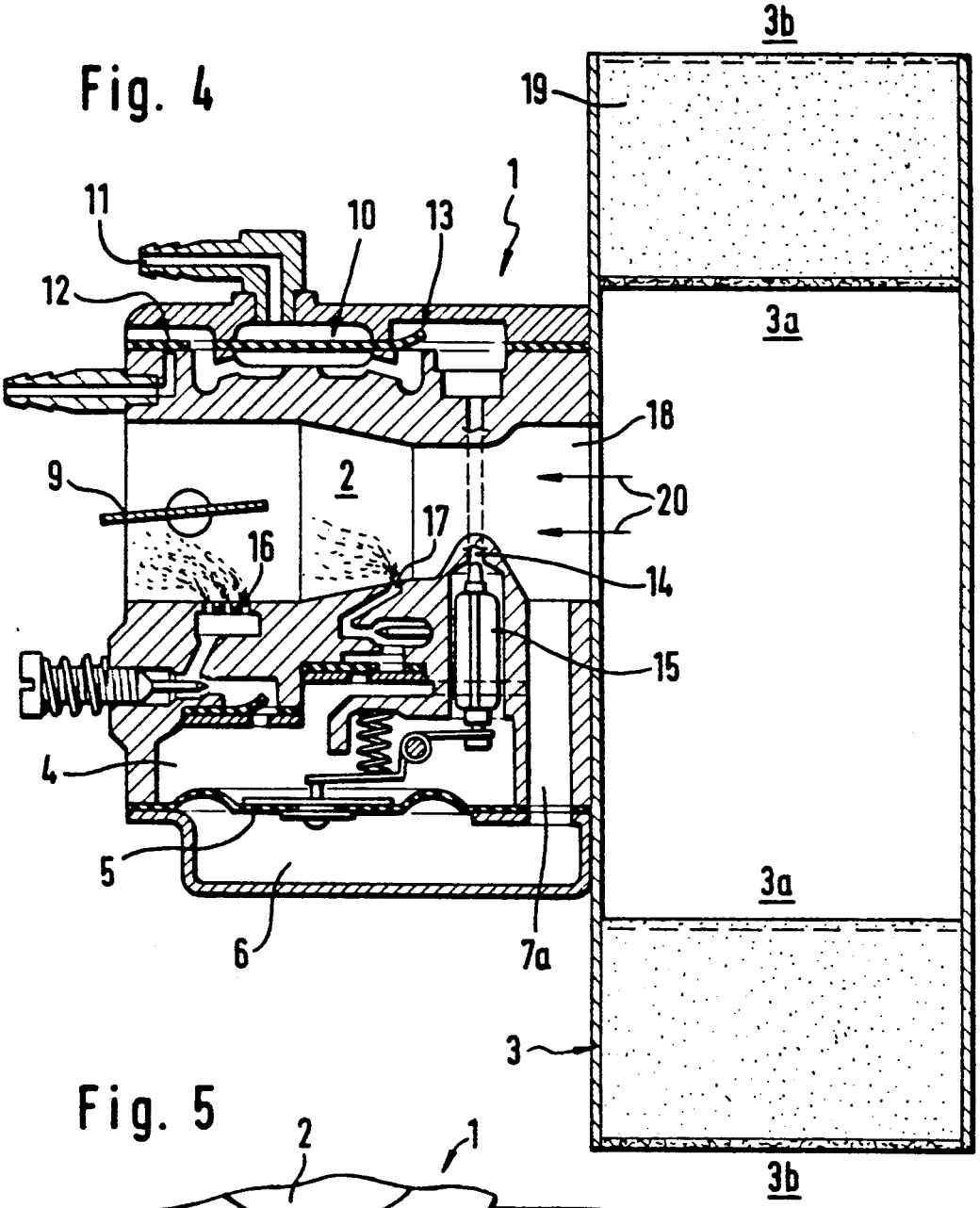
FIG. 4 is a side elevation view, in section, wherein the carburetor includes a connecting channel arranged within the carburetor per se; and, FIG. 5 is a broken-out portion, partially in section, showing a further embodiment of a membrane carburetor of the invention with the air filter removed.

In a further embodiment of the invention according to FIG. 4, it is advantageous to provide the connecting channel 7*a* in the housing of the membrane carburetor 1 so that changes in the air filter housing are not necessary. This is especially then advantageous if the same membrane carburetor is to be driven with different types of air filters. In the event it is required, a hose connected between the compensation chamber 6 and the clean-air side 3*a* of the air filter 3 can be provided in lieu of an insert channel 7 (FIG. 1) if required.

Figure 5:
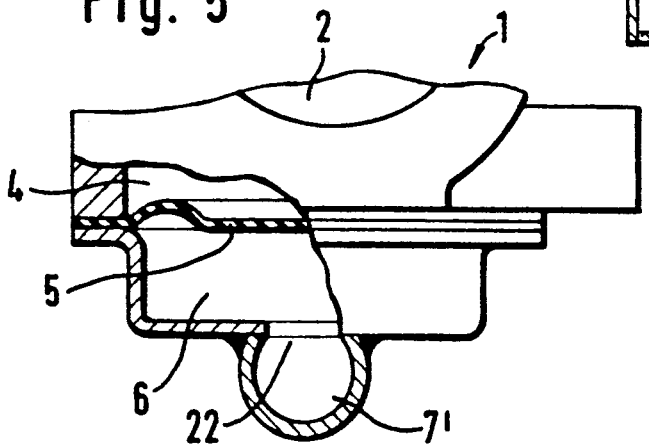

According to the embodiment of FIG. 5, the connecting channel 7' is formed from a tube piece and provides a configuration which is simple to construct and which can be attached to the base of the compensation chamber 6 and is preferably soldered thereto. The tube piece has an opening 22 in the region of the compensation chamber 6 and this opening lies opposite a corresponding opening in the base. The tube piece is closed at one end and at its other end, the tube piece opens into the clean space of the air filter.

It is understood that the foregoing description is that of the preferred embodiments of the invention and that various changes and modifications may be made thereto without departing from the spirit and scope of the invention as defined in the appended claims.

What is claimed is:

1. A membrane carburetor for an internal combustion engine such as a two-stroke engine of a portable handheld tool such as a motor chain saw, cutoff machine, brushcutter or the like, the membrane carburetor comprising:

a housing having an interior space and defining an intake channel communicating with the engine and through which a stream of air is drawn by suction when the engine is operating;

an air filter mounted upstream of said intake channel for filtering and passing said stream of air into said channel;

said air filter having a clean-air side downstream of said filter;

a movable control membrane having two sides and mounted in said space so as to define a fuel chamber on one side of said membrane in which fuel is drawn into said intake channel to form a fuel/air-mixture with said intake air and a closed compensation chamber on the other side of said membrane;

connecting channel means for connecting said compensation chamber to said stream of air at a location downstream of said clean-air side of said air filter;

said membrane having a membrane surface and said connecting channel means being a connecting channel having a channel cross section; and, said membrane surface and said channel cross section defining a ratio of less than approximately 10:1.

2. The membrane carburetor of claim 1, said air filter including a housing and filter material contained in said housing; said housing having a sleeve-like connector piece formed thereon; and, said connecting channel means being a connecting channel inserted into said sleeve-like connector for connecting said compensation chamber to said housing.

3. The membrane carburetor of claim 1, said connecting channel means being a single connecting channel.

4. A membrane carburetor for an internal combustion engine such as a two-stroke engine of a portable hand-held tool such as a motor chain saw, cutoff machine, brushcutter or the like, the membrane carburetor comprising:

a housing having an interior space and defining an intake channel communicating with the engine and through which a stream of air is drawn by suction when the engine is operating;

an air filter mounted upstream of said intake channel for filtering and passing said stream of air into said channel;

said air filter having a clean-air side downstream of said filter;

a movable control membrane having two sides and mounted in said space so as to define a fuel chamber on one side of said membrane from which fuel is drawn into said intake channel to form a fuel/air mixture with said intake air and a closed compensation chamber on the other side of said membrane;

connecting channel means for connecting said compensation chamber to said stream of air at a location downstream of said clean-air side of said air filter;

said membrane having a membrane surface and said connecting channel means being a connecting channel having a channel cross section;

said membrane surface and said channel cross section defining a ratio of less than 50:1;

an intermediate wall disposed in said space adjacent said other side of said control membrane so as to define an intermediate space between said membrane and said compensation chamber; said intermediate wall having an opening formed therein; and, said opening having a predetermined opening cross section and said membrane surface and said opening cross section defining a ratio of less than 200:1 with said opening cross section being at least approximately 3 $mm^2$.

5. A membrane carburetor for an internal combustion engine such as a two-stroke engine of a portable hand-held tool such as a motor chain saw,, cutoff machine, brushcutter or the like, the membrane carburetor comprising:

a housing having an interior space and defining an intake channel communicating with the engine and through which a stream of air is drawn by suction when the engine is operating;

an air filter mounted upstream of said intake channel for filtering and passing said stream of air into said channel;

said air filter having a clean-air side downstream of said filter;

a movable control membrane having two sides and mounted in said space so as to define a fuel chamber on one side of said membrane from which fuel is drawn into said intake channel to form a fuel/air-mixture with said intake air and a closed compensation chamber on the other side of said membrane;

connecting channel means for connecting said compensation chamber to said stream of air at a location downstream of said clean-air side of said air filter;

said compensation chamber having a wall defining an opening therein; and, said channel means being a connecting pipe having an annular side wall; and, said side wall having an opening formed therein communicating with said opening of said wall of said compensation chamber.

6. A membrane carburetor for an internal combustion engine such as a two-stroke engine of a portable hand-held tool such as a motor chain saw, cutoff machine, brushcutter or the like, the membrane carburetor comprising:

a housing having an interior space and defining an intake channel communicating with the engine and through which a stream of air is drawn by suction when the engine is operating;

an air filter mounted upstream of said intake channel for filtering and passing said stream of air into said channel;

said air filter having a clean-air side downstream of said filter;

a movable control membrane having two sides and mounted in said space so as to define a fuel chamber on one side of said membrane from which fuel is drawn into said intake channel to form a fuel/air-mixture with said intake air and a closed compression chamber on the other side of said membrane;

a connecting channel means for connecting said compensation chamber to said stream of air at a location downstream of said clean-air side of said air filter; and, said compensation chamber having a diameter and said channel means being a connecting channel having a width corresponding approximately to said diameter.

7. The membrane carburetor of claim 6, said compensation chamber having a height and said connecting channel having a height corresponding approximately to said height of said compensation chamber.

* * * * *

UNITED STATES PATENT AND TRADEMARK OFFICE

CERTIFICATE OF CORRECTION

PATENT NO. : 5,073,307

DATED : December 17, 1991

INVENTOR(S) : Michael Langer and Joachim Schommers

It is certified that error appears in the above-identified patent and that said Letters Patent is hereby corrected as shown below:

In column 5, line 8: delete "in" and substitute -- from -- therefor.

In column 6, line 52: delete "compression" and substitute -- compensation -- therefor.

In column 6, line 54, delete "a".

Signed and Sealed this

Eleventh Day of May, 1993

*Attest:*

Michael K. Kirk

MICHAEL K. KIRK

*Attesting Officer*

*Acting Commissioner of Patents and Trademarks*